United States Patent [19]

Brandeau

[11] 4,288,917

[45] Sep. 15, 1981

[54] METHOD OF FORMING CONNECTOR-CABLE WITH CRIMPED ELECTRICAL TERMINATIONS

[75] Inventor: Edward P. Brandeau, Willimantic, Conn.

[73] Assignee: Akzona Incorporated, Asheville, N.C.

[21] Appl. No.: 17,368

[22] Filed: Mar. 5, 1979

Related U.S. Application Data

[60] Division of Ser. No. 918,813, Jun. 26, 1978, Pat. No. 4,173,388, which is a continuation of Ser. No. 771,109, Feb. 23, 1977, abandoned.

[51] Int. Cl.[3] ..... H01R 43/02

[52] U.S. Cl. ..... 29/860

[58] Field of Search ..... 29/629, 628, 630 R, 29/630 A, 749, 566.3, 860; 339/17 F, 275 T, 99 R

[56] References Cited

U.S. PATENT DOCUMENTS 3,573,719 4/1971 Lightner ..... 339/275 T X
3,864,011 2/1975 Huber ..... 339/17 F X
3,909,935 10/1975 Aldridge et al. ..... 29/628
3,920,301 11/1975 Roberts et al. ..... 339/17 F
4,086,697 5/1978 Brandeau et al. ..... 29/749

*Primary Examiner*—Charlie T. Moon
*Assistant Examiner*—C. J. Arbes
*Attorney, Agent, or Firm*—Leydig, Voit, Osann, Mayer & Holt, Ltd.

[57] ABSTRACT

A connector-cable assembly in which a flat, multiple wire cable is secured in a connector body through a transverse, sharply angled rib, and the stripped wire ends are terminated into a plurality of plate members disposed in parallel planes and spaced longitudinally of the wires to provide mounting and working space. Each wire is terminated by being progressively urged and then forced into an open throated slot formed in one of the plate members. The slots are formed so that there is intimate, large area contact, and wedge resistance to linear pull-out. The plate members are plated for corrosion resistance and a heating step following mechanical connection causes melting or intermetallic diffusion. The rib not only provides strain relief, but also indexes the cable end for assembly and anchors the cable for partial stripping—the latter permitting simultaneous and convenient positioning of the wires.

5 Claims, 16 Drawing Figures

Fig. 10.
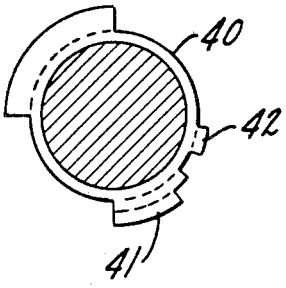
Fig. 11.
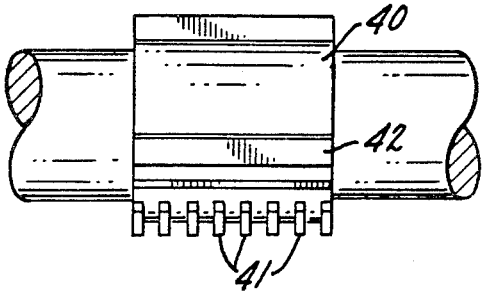
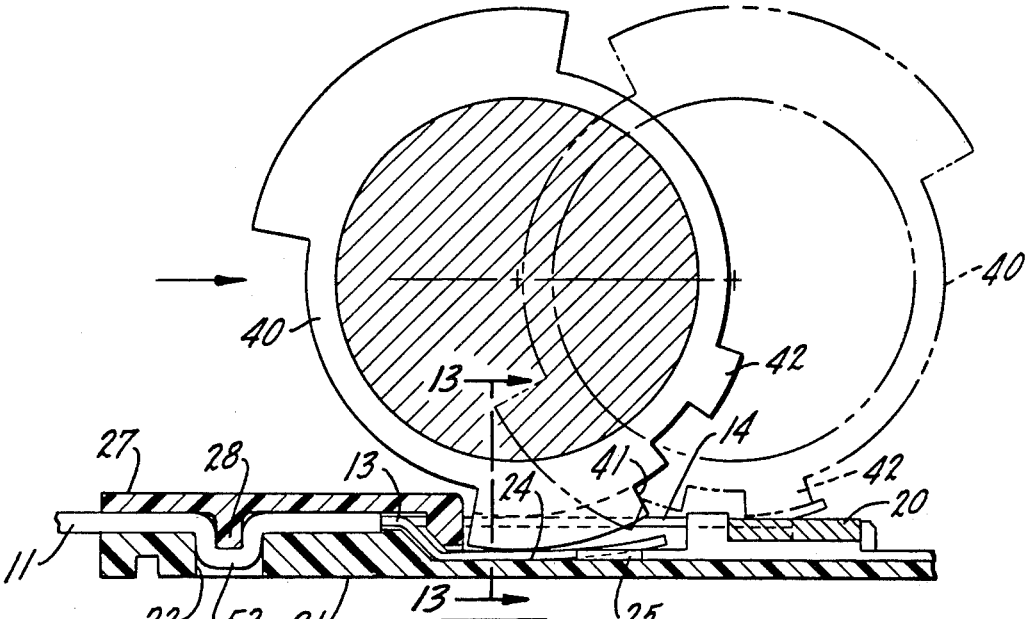
Fig. 12.
Fig. 13.
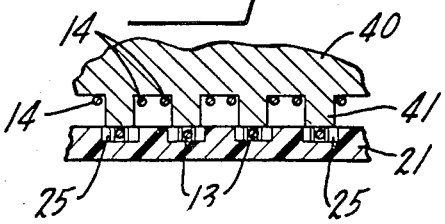

METHOD OF FORMING CONNECTOR-CABLE WITH CRIMPED ELECTRICAL TERMINATIONS

This is a division, of application Ser. No. 918,813, filed June 26, 1978, now U.S. Pat. No. 4,173,388, issued Nov. 11, 1979, which in turn is a continuation of U.S. Ser. No. 771,109, filed Feb. 23, 1977, now abandoned.

This invention relates generally to electrical connector-cable assemblies and more particularly concerns a form of crimped termination embodied in such assemblies.

Signal carrying cable for such applications as telephone switching units and computer hardware jumpers are typically formed as triplets, a signal carrying wire being flanked by a pair of ground wires to insure signal isolation. Since small amounts of power are involved, such wire is typically quite fine and often multiple signal wires, each with shielding ground wires, are formed in one cable. One version of such cable provides, in a flat cable only about ¾ of an inch wide and 1/32 of an inch thick, eight signal wires each flanked by a pair of ground wires for a total of twenty-four wires spaced on approximate 1/32 inch centers.

Connectors for such multiple strand cable must, basically, electrically terminate the signal and ground wires, and provide a transition to connector sockets on 1/10 or ⅛inch centers which are typical pin spacings on circuit boards. In the past, connectors were formed with cast transition elements to which the wires of the cable were hand soldered but, as will be apparent from the sizes involved, this is a difficult, expensive assembly technique.

At first glance, a form of piercing or insulation penetrating connection appears attractive for this kind of use, but the insulating material used on such cable is typically quite tough, and the small wire diameters make it difficult to expect reliable contact. The alternative is to strip the cable, and that presents the problem of positioning and controlling, in the example referred to above for example, twenty-four fine wires requiring termination.

A further requirement of a cable-connector of this type is adequate strain relief which, in this context, is not so much a matter of locking the cable against being pulled linearly out of the connector as it is of preventing even small amounts of relative movement of the cable in the connector. That is, allowing even a slight twisting in the plane of a flat cable could easily "work" and snap the thin wires in the connector.

Finally, a cable-connector design must, particularly for telephone use, be expected to perform virtually "as new" for forty years, and accelerated aging tests are commonly employed to evaluate this parameter.

It is, therefore, the primary aim of the invention to solve the problems alluded to above with a cable-connector using a form of crimped electrical termination.

In more detail, it is an object of the invention to provide a crimped termination that avoids notching or guillotining the wire, that is self-aligning and tolerant of part size differences, and that results in a large area, gas tight, residual force electrical connection that can readily be expected to survive forty year aging tests. A related object is to provide a termination of the foregoing type which results in the cutting away of portions of the wire, right through surface discontinuities or even magnet wire insulation, to get "new" copper into intimate electrical contact with the termination strip.

A further object is to provide a crimped termination of the above kind in which the terminal element but not necessarily the wire is plated with the result that plating material lubricates the crimping action and wipes into the interface so that a quick heating step produces intermetallic diffusion with the plating virtually alloying into the copper of the wire.

Another object is to provide a termination as characterized above that avoids overcrimping problems by being virtually insensitive to excess pressure. A collateral object is to provide a termination of this kind that can be made using simple, inexpensive and portable tooling since no critical gauging or control is required. A further related object is to provide a procedure for making gang terminations of the above character as conveniently as making a single such connection, with a partial stripping technique facilitating quick and convenient handling of multiple closely spaced wires.

In one of its aspects, it is an object of the invention to provide a cable-connector configuration for efficiently utilizing crimped terminations of the above kind by disposing multiple wires for termination into two planes and two spaced rows so as to provide sufficient room for mechanical working as well as material strength. A collateral object is to provide a cable-connector of the foregoing type having a rib-type of strain relief that initially holds the cable for controlled stripping, thereafter indexes the cable properly relative to the tooling and the connector, and finally reliably locks the cable to the connector against both linear force as well as planar twisting.

Other objects and advantages of the invention will become apparent upon reading the following detailed description and upon reference to the drawings, in which.

Figure 7:
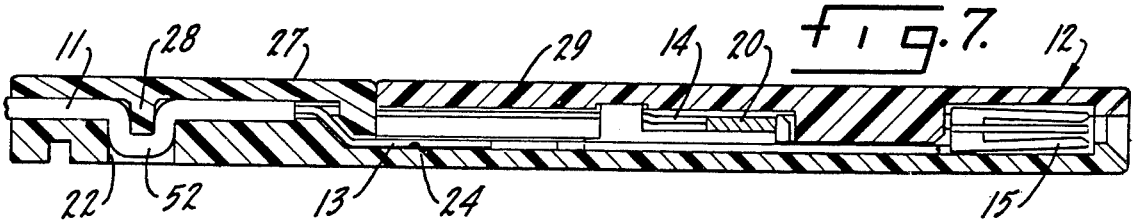
Figure 8:
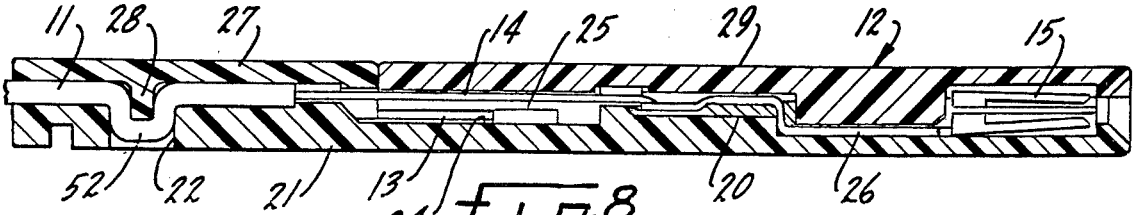
Figure 6:
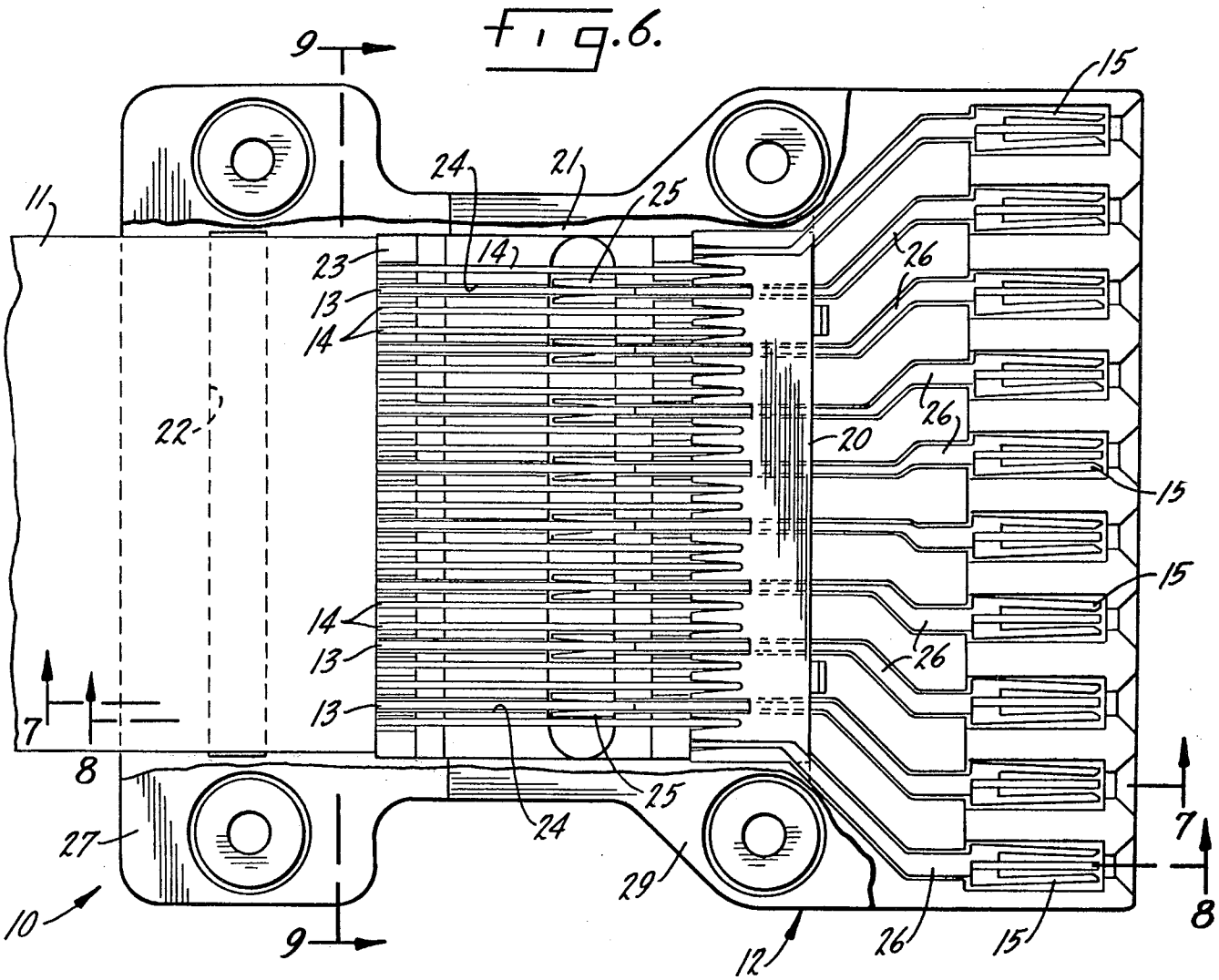
FIG. 6 is an enlarged elevation similar to FIG. 1 with portions of the connector casing broken open.
Figure 9:
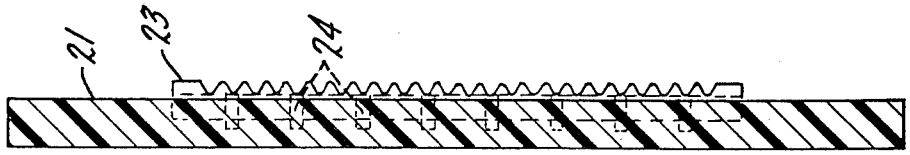
Figure 14:
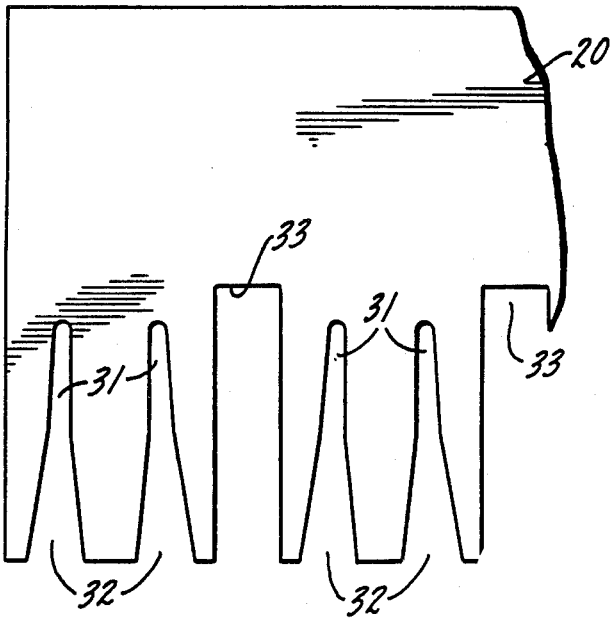
Figure 15:
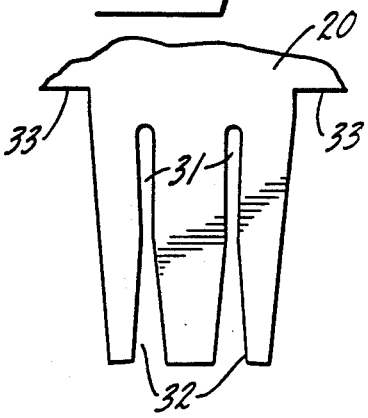
Figure 16:
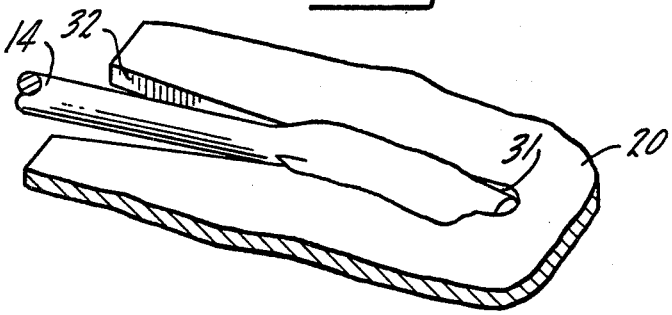

FIGS. 7 and 8 are sections taken approximately along the lines 7—7 and 8—8 in FIG. 6;

FIG. 9 is a fragmentary section taken approximately along the line 9—9 in FIG. 6;

FIGS. 10 and 11 are fragmentary side and front elevations of tooling used in the practice of the invention;

FIG. 12 is an enlarged somewhat diagrammatic section showing the use of the tooling of FIGS. 10, 11;

FIG. 13 is a fragmentary section taken approximately along the line 13—13 in FIG. 12;

FIG. 14 is an enlarged fragmentary plan of a terminal strip embodied in the connector of FIG. 6;

FIG. 15 is similar to FIG. 14 but shows the effect of a further forming step; and FIG. 16 is a perspective view of a crimped termination following the crimping step.

While the invention will be described in connection with a preferred embodiment and procedure, it will be understood that I do not intend to limit the invention to those embodiments or procedures. On the contrary, I intend to cover all alternatives, modifications and equivalents as may be included within the spirit and scope of the invention as defined by the appended claims.

Turning now to the drawings, there is shown an assembly 10 embodying the invention that includes a cable 11 and a connector 12 that, in the illustrated form, couple twenty-four wires 13 and 14 in the cable 10 to ten pin sockets 15 in the end of the connector 12. The illustrated cable 11 is a multiple triplex type in which there are eight signal wires 13 each flanked by two ground wires 14. In the connector 12, the sixteen ground wires 14 are terminated to a common bus plate member 20 that is electrically coupled to the two opposite end sockets 15 of the ten socket array. The eight signal wires 13 are electrically coupled respectively to the eight intermediate sockets 15 in the array.

The illustrated connector 12 includes a base plate 21 having a locking groove 22, a wire guide 23, a series of grooves 24 in one plane for the signal wires 13, and a second planar support for the ground bus plate member 20. A plurality of individual plate members 25 are fitted in the grooves 24, one for each signal wire 13. The sockets 15 are of the conventional spring type and are nested in the outer end of the connector base plate 21 on the desired centers, typically $\frac{1}{8}$ inch apart, so as to plug into a circuit board pin array. Thin metal transition strips 26 electrically connect the end sockets 15 to the plate member 20 and the middle sockets 15 to respective ones of the signal wire plate members 25. The connector 12 also includes a lock plate 27 having a rib 28 fitting into the groove 22, and a cover plate 29 fitting over and complementing the remaining portions of the base plate 21.

It will be appreciated that the signal plate members 25 and the ground bus plate 20 are in spaced but parallel planes, and are relatively spaced longitudinally of the wires 13, 14. This allows sufficient room for the members 25 to be formed for adequate strength, and also allows the termination regions of both the signal and ground wires to be worked from the "top" of the connector base plate 21.

Each of the wire termination regions involves essentially the same structure which will be explained in terms of a portion of the ground bus plate member 20. In the case of the member 20, it is slotted to widths somewhat narrower than the wire to be received, with each of the slots 31 being opened in an outwardly tapering throat 32 to one edge of the member 20. Initially, see FIG. 14, the member 20 is slotted so that the slot walls longitudinally of the slot are parallel or even somewhat outwardly tapered so as to facilitate the cutting operation. However, large notches 33 are also formed between pairs of the open throated slots 31 and, using the notches 33 to get gripping access, the sides of the slots 31 are slightly pressed together (see FIG. 15) so that the slots 31 become somewhat necked down before opening into the throats 32.

As observed above, the plate members 25 are similarly formed and slotted, although single rather than double slots are involved.

In carrying out the invention, the terminating wire such as one of the wires 14, is laid into the throat 32 and forced down into the slot 31 so as to provide intimate contact between the materials of the wire and the plate member 20 along a short longitudinal length of the wire. The wire end portion, the material typically being copper, has its sides sheared and coined or mashed into the slot 31. Because the slot is necked down before widening at the throat 32, and the wire is mashed into the slot behind the necked down area, the wire becomes wedged against the linear pull-out.

In the connector 12, all of the plate members 20, 25 have their slots and throats facing the same direction so that all of the wires 13, 14 of the cable 11 can be laid into the throats simultaneously, and then gang terminated by applying force to the wires progressively from the open throats 32 toward the slots 31 so as to first wedge-guide the wire end portions over the slots 31 and then force the wire material into the slots by cutting and deforming the wire ends. One form of tooling for this purpose is a roller 40 having feet 41 adapted to roll the signal wires 13 into the plate members 25, and a bar type of continuous foot 42 adapted to roll all of the ground wires 14 into the slots 31 in the bus plate member 20.

As a feature of the invention, the plate members 20, 25 are plated for corrosion resistance using, typically, an indium alloy. As a result, portions of the plating are wiped down into the interfaces between the metal of the wires and that of the plate members. A quick heating step using, for example, a quartz infra red lamp to impulse the parts to approximately 400° F. causes intermetallic fusion or melting of the plating and the wire and plate member metals, thus creating a gas tight joint as fused as a brazed or soldered connection.

Figure 1:
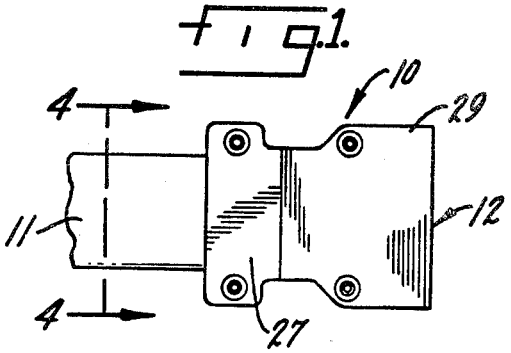
FIGS. 1 and 2 are top and side elevations, respectively, of a cable-connector assembly embodying the invention.
Figure 2:
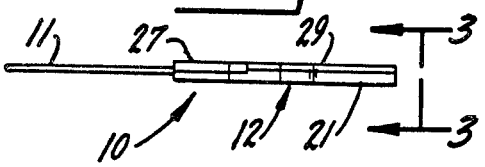
Figure 3:
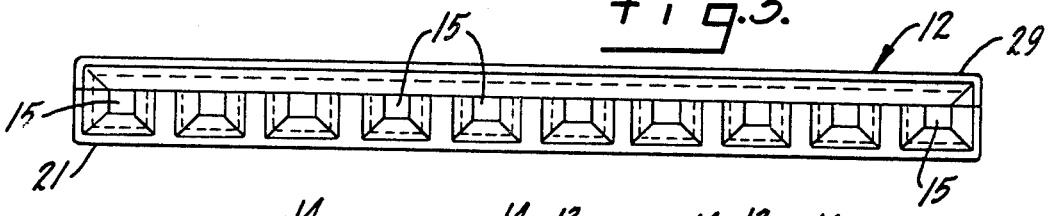
FIG. 3 is an enlarged end elevation taken approximately along the line 3—3 in FIG. 2.
Figure 4:
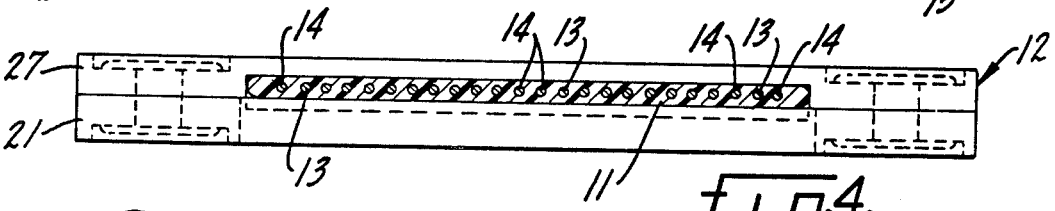
FIG. 4 is an enlarged section taken approximately along the line 4—4 in FIG. 1.
Figure 5:
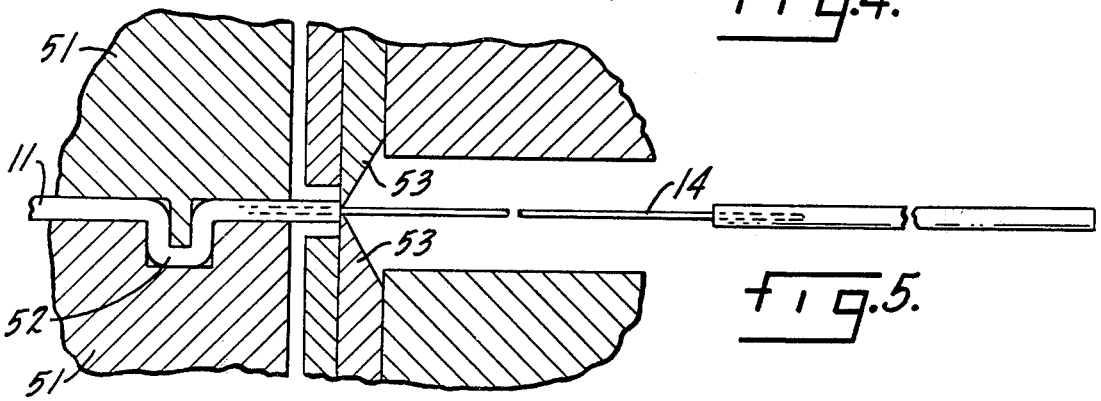
FIG. 5 is a side elevation of a cable end and a stripping tool used in the practice of the invention.

Pursuant to the invention, the cable-connector assembly 10 is made using additional simple tooling and easily visualized steps starting with a forming and stripping tool having dies 51 (see FIG. 5) for clamping the cable 11 and bending a sharply angled rib 52 in the cable. With the cable so gripped, stripping knives 53 cut into the cable insulation and pull the cut insulation toward but not completely free of the ends of the wires. The cut insulation thus serves to prevent the fine wires of the cable from becoming tangled or dislocated during subsequent handling.

With the connector base plate 21 positioned relative to the terminating roller tool 40, the stripped cable end is placed in a simple forming and cutting tool (not shown), the cable rib 52 serving as a positive indexing member, for cutting the signal and ground wires 13, 14 to their proper respective lengths and jog bending the signal wires 13 to the shape shown in FIG. 7. The so prepared cable end is then placed in the connector base plate 21, the rib 52 fitting in the slot 22 for proper indexing of the parts, and the wires are terminated as described above. A quick heating step achieves fusion, and the remaining parts 27 and 29 of the connector 12 are assembled to complete the cable termination.

There are a number of important advantages of the crimping technique disclosed that may not be immediately apparent. One important feature is that it is virtually impossible to overcrimp. As suggested in FIG. 16, once the material of the wire is coined or mashed down into the slot 31, the crimping force is virtually a pure compression force on the material of the plate member with there being little likelihood of such a force damaging the parts or otherwise jeopardizing the integrity of the termination. It follows from this that no exact gauging or precise tooling is required, so that the terminating technique is well suited for rough and ready, in-the-field use.

Another factor simplifying tooling requirements, and for that matter operators' skill and technique in making the assembly 10, is that there are no critically interfitting parts. The tooling is not required to enter the slots 31 and need only clear the adjacent parts of the assembly so as to press the wire metal into the underlying slots.

Perhaps most important, the termination technique disclosed produces a large area, running longitudinally of the wire, gas tight, residual force, connection between the wire and the terminating plate member which, particularly if the plating and heat treating step is utilized, provides a truly diffused electrical connection. The large area insures that the joint itself does not constitute an electrical resistance greater than that of the wire itself. The gas tight nature keeps out moisture as well as air and other corrosion or oxidation encouraging substances.

The tight mechanical locking of the wire in a terminating groove together with the clamping of the cable rib 52 in the long transverse groove 22 minimizes the possibility of vibration "working" and eventually snapping the wires and, of course, there is minimal possibility of wire pull-out from the terminating grooves.

Two important results flow from the fact that the wire sides are cut away when the wire is mashed into the groove 31. First, it will be apparent that this permits relative freedom from maintaining extremely close tolerances and, indeed, wire of slightly differing size can be easily accommodated by a given termination plate member. Secondly, since the sides of the wire are literally cut away, the cutting action takes place through surface wire discontinuities such as dirt or corrosion and even permits effective electrical connection through the insulation of magnet wire.

Those skilled in the art will appreciate that plating the ends of wire to be electrically connected is an expensive procedure difficult to quality control. The disclosed termination technique accomplishes much the same objective as a result of plating the terminating plate members, rather than the wire ends, as well as protecting all surfaces of the plate members against corrosion.

Finally, in contrast with other techniques of mechanically connecting wires, particularly small wires, there is virtually no danger of notching the wires 13, 14 in making the terminations disclosed, much less any likelihood of outright guillotining, i.e. shearing through, the wire.

I claim as my invention:

1. In the method of making a cable termination assembly, the steps comprising, bending a flat, insulated multiple wire cable near one end into a sharply angled rib, using said rib as an anchor when cutting the cable insulation and pulling the cut insulation toward but not completely free of the ends of said cable wires so that the cable can be handled without disarranging the stripped wires by manipulating the partially stripped insulation, fitting said cable end in a connector body using said rib and a locking groove in the body as indexing members, and simultaneously laying said wires in proper position for termination within said body.

2. A method of terminating a fine wire in an electrical contact which has a wire-receiving slot open at least on one side and extending a distance along the length of the contact from a wide throat tapering to a portion along its length narrower than the wire to be terminated, the throat of said slot being substantially wider than the wire, said method comprising the steps of positioning a length of said wire approximately in alignment along the length of the contact slot, pushing said wire into the throat of said slot while allowing wire and contact to position themselves precisely relative to each other through the guiding action of a slot edge along a surface of said wire, progressively forcing the wire into the contact slot along its length, and substantially mashing or coining the wire into the narrow portion of the slot to cut or skive the surface of the wire whereby a clean, gas-tight, high pressure joint between wire and contact is effected and the mechanical strength of the wire is substantially maintained.

3. The method in claim 2 in which said contact in the vicinity of said slot is coated with a heat-reflowable metal alloy, in further combination with the step of wiping said alloy against cleaned portions of said wire during coining in said slot, and the step of reflowing said alloy after said wire has been coined in said slot whereby a termination substantially as fused as a soldered connection is obtained.

4. A method of gang terminating a number of fine, closely spaced wires in an insulated flat cable to respective contacts in an electrical connector, each contact in the connector having a lengthwise wire-receiving slot open along a side and tapering from a wide throat to a narrow portion, the contacts in said connector lying in at least one plane and in spaced rows within the body of said connector, the body of said connector providing a strain relief area along an edge thereof adjacent said contacts, said method comprising the steps of removing a portion of the insulation from said cable at a selected zone along its length, positioning the exposed portions of said wires closely adjacent and approximately aligned with the length of respective ones of said contact slots and anchoring said cable in the strain relief area of said connector, pushing each of said wires into respective ones of the throats of said slots, forcing said wires and contacts together while allowing each wire to align itself precisely along its respective slot, and mashing or coining each wire into the narrow portion of a respective slot so that a clean, gas-tight, high pressure electrical connection is effected, whereby cutting or guillotining of the wires is obviated and the mechanical and electrical integrity of the wires after termination is maintained.

5. The method of claim 4 wherein said contacts in the region of said slots are coated with a heat-reflowable metal alloy, in further combination with the step of melting said reflowable alloy after said wires are terminated to said contacts thereby obtaining terminations as fused as brazed or soldered connections.

* * * * *